US006955441B1

(12) United States Patent
Chen

(10) Patent No.: US 6,955,441 B1
(45) Date of Patent: Oct. 18, 2005

(54) ORNAMENTAL TUBE FOR DECORATIVE LAMP ASSEMBLY

(76) Inventor: Ching-Chao Chen, No. 511, Sec. 3, Dong Ta Rd., Hsinchu City (TW)

( * ) Notice: Subject to any disclaimer, the term of this patent is extended or adjusted under 35 U.S.C. 154(b) by 49 days.

(21) Appl. No.: 10/796,986

(22) Filed: Mar. 11, 2004

(51) Int. Cl.[7] ..... F21V 33/00

(52) U.S. Cl. ..... 362/96; 362/565; 362/582; 362/641; 362/644; 362/318; 362/368; 362/439; 362/310

(58) Field of Search ..... 362/806, 565, 362/96, 641, 644, 318, 368, 439, 310; 313/110, 313/111

(56) References Cited

U.S. PATENT DOCUMENTS 1,856,098 A * 5/1932 Green ..... 40/406
2,412,379 A * 12/1946 Abramson ..... 40/406
2,520,691 A * 8/1950 Otis ..... 313/110
5,105,343 A * 4/1992 Wakimoto ..... 362/101
6,416,197 B1 * 7/2002 Chang ..... 362/96
6,464,368 B1 * 10/2002 Chen ..... 362/96
6,585,387 B1 * 7/2003 Lee ..... 362/96
2003/0012016 A1 * 1/2003 Lee ..... 362/124

* cited by examiner

*Primary Examiner*—Sandra O'Shea
*Assistant Examiner*—Sharon Payne
(74) *Attorney, Agent, or Firm*—Troxell Law Office, PLLC

(57) ABSTRACT

An ornamental tube used in a decorative lamp assembly for heating by heat energy from the lamp bulb to boil an organic solvent into a convection of bubbles is disclosed having a plastic tube body holding the organic solvent, a plastic bottom cap capped on the bottom open side of the tube body, a porous cushion mounted in the plastic bottom cap and adapted to absorb the organic solvent for heating by heat energy from the lamp bulb, and a spacer member mounted in the plastic bottom cap to seal the bottom open side of the tube body and to hold down the porous cushion in the plastic bottom cap, the spacer member having through holes for the passing of the organic solvent from the tube body to the porous cushion.

6 Claims, 11 Drawing Sheets

ORNAMENTAL TUBE FOR DECORATIVE LAMP ASSEMBLY

BACKGROUND AND SUMMARY OF THE INVENTION

The present invention relates to a decorative lamp assembly and more particularly, to such a decorative lamp assembly, which causes colored tiny plastic balls to move up and down with bubbles in an enclosed ornamental tube when turned on to emit light.

FIGS. 1~3 show a decorative lamp assembly 9 according to the prior art. This structure of decorative lamp assembly 9 is comprised of an adapter 91, a bulb 911, a lampshade 92, and an ornamental tube 93. The adapter 91 has a socket side adapted to receive the bulb 911, and a plug side adapted to receive power supply from an electric outlet. The lampshade 92 is comprised of an upper shell 921 and a bottom shell 922. The ornamental tube 93 is an enclosed tube of glass material, having a porous bottom stuffing layer 931 formed of sodium silicate ($NaSiO_2$) and silica ($SiO_2$), and an upper stuffing material of dichloromethane ($Ch_2Cl_2$) 90. During fabrication of the ornamental tube 93, sodium silicate ($NaSiO_2$) and silica ($SiO_2$) are put in the tube and heated to about 30°~35° C. When cooled down, sodium silicate is condensed and bonded to the inside wall of the tube. After formation of the porous bottom stuffing layer 931, dichloromethane 90 is put in the tube with a space left above dichloromethane 90, and then the tube is sealed after exhaust of inside air. The lampshade 92 is fastened to the adapter 91 around the bulb 911. The ornamental tube 93 is fastened to the top side of the upper shell 921 of the lampshade 92, keeping the bottom end suspended above the bulb 911. When turned on the bulb 911, heat energy is transmitted from the bulb 911 through the porous bottom stuffing layer 931 to the upper stuffing material of dichloromethane 90 to boil dichloromethane 92 into bubbles 900. At the same time, light rays pass from the bulb 911 through the porous bottom stuffing layer 931 and the bubbles 900, producing a lighting effect.

The ornamental tube 93 of the aforesaid decorative lamp assembly has drawbacks as follows:

1. Because the ornamental tube is made of glass, it tends to break, and the broken chips of the glass material may injure a person accidentally.
2. It takes much time to have heat energy be transmitted from the bulb 911 through the porous bottom stuffing layer 931 to the upper stuffing material of dichloromethane 90 to boil dichloromethane 92 into bubbles 900.
3. It is difficult to control the quality of the porous bottom stuffing layer 931 by using sodium silicate ($NaSiO_2$) and silica ($SiO_2$) to make the porous bottom stuffing layer 931. If the pores of the porous bottom stuffing layer 931 are not well controlled, convection of bubbles become unstable.

Therefore, it is desirable to provide an ornamental tube for decorative lamp assembly that eliminates the aforesaid drawbacks.

The present invention has been accomplished under the circumstances in view. It is therefore one object of the present invention to provide an ornamental tube for use in a decorative lamp assembly to produce a convection of bubbles, which is safe in use. It is another object of the present invention to provide an ornamental tube for use in a decorative lamp assembly to produce a convection of bubbles, which greatly shortens the heating time to heat the filled organic solvent to the boiling status. It is still another object of the present invention to provide an ornamental tube for use in a decorative lamp assembly, which produces a stable convection of bubbles quickly after the lamp bulb has been turned on. To achieve these and other objects of the present invention, the ornamental tube fastened to the lampshade of a lamp and holding an organic solvent for heating into a boiling status by heat energy from a lamp bulb in the lampshade to produce a convection of bubbles below an inside space thereof, the ornamental tube comprising a plastic tube body holding the organic solvent and defining the space above the organic solvent, the plastic tube body admitting light and having an open bottom side, a plastic bottom cap capped on the open bottom side of the plastic tube body, the plastic bottom cap admitting light, a spacer member mounted inside the plastic bottom cap and sealed to the bottom open side of the tube body, the plastic bottom cap having a plurality of through holes through top and bottom sides thereof for guiding the organic solvent from the tube body to the inside of the plastic bottom cap for heating by heat from the lamp bulb, and a porous cushion mounted in between the plastic bottom cap and the spacer member and adapted to absorb the organic solvent for heating by heat energy from the lamp bulb.

DETAILED DESCRIPTION OF THE INVENTION

Figure 1:
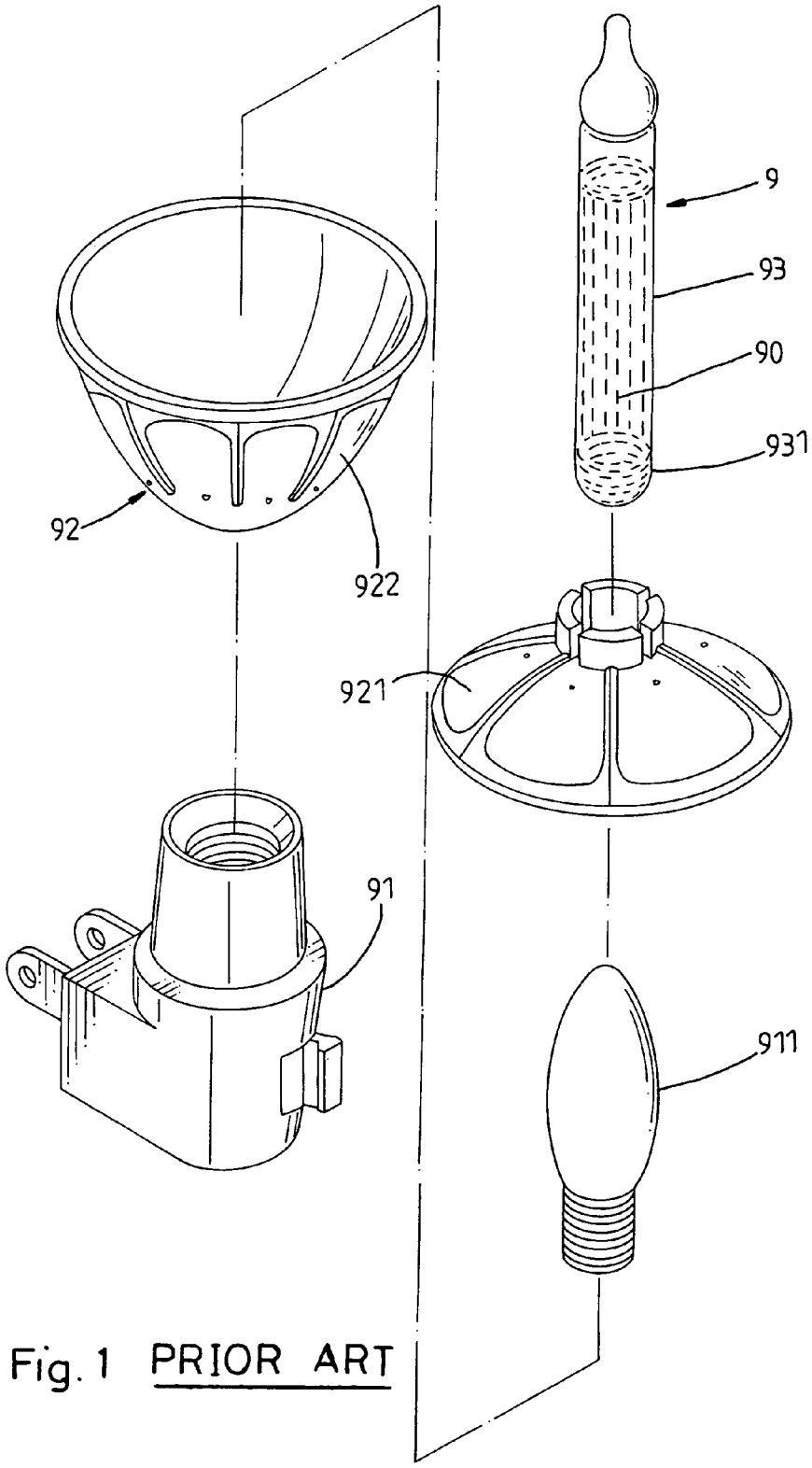
Fig. 1 PRIOR ART
FIG. 1 is an exploded view of a decorative lamp assembly according to the prior art.
Figure 2:
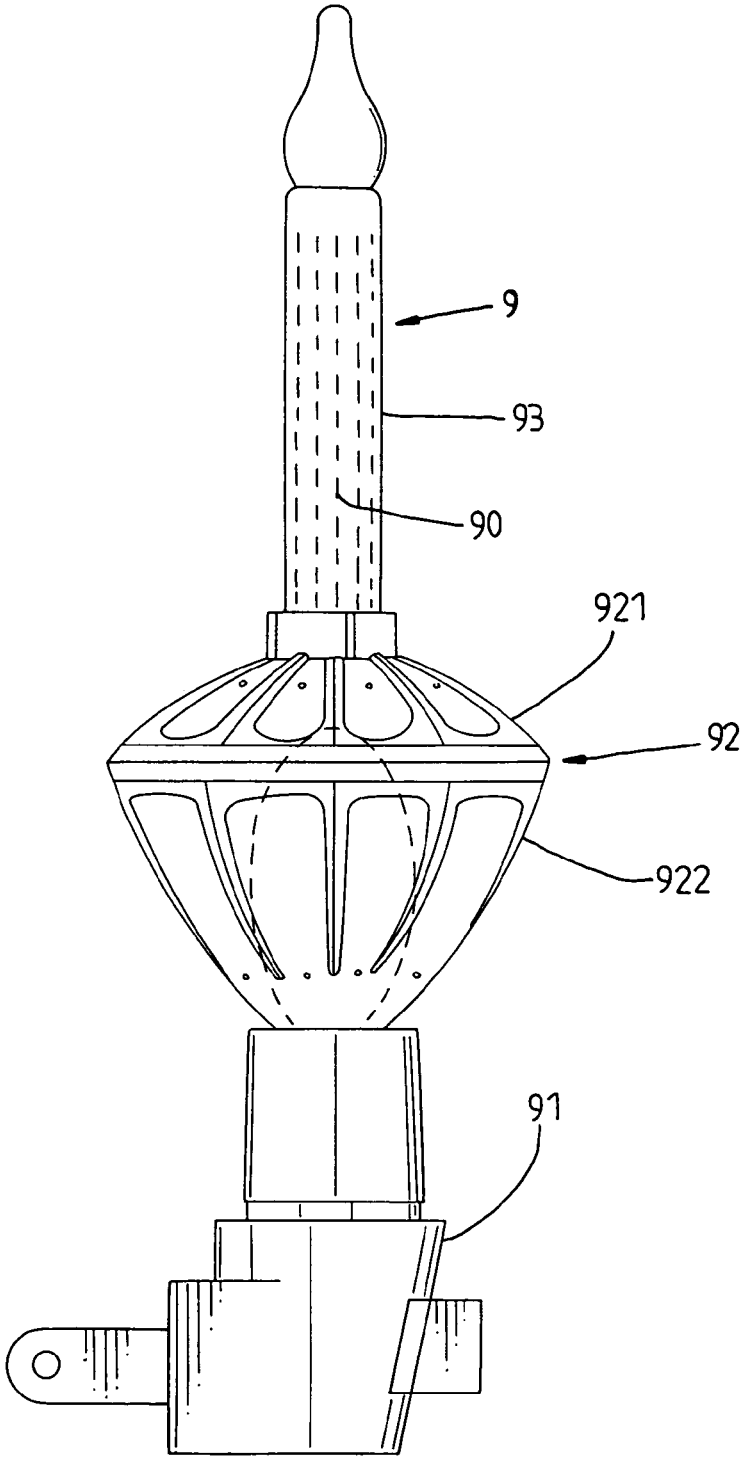
Fig. 2 PRIOR ART
FIG. 2 is a plain view of the decorative lamp assembly according to the prior art.
Figure 3:
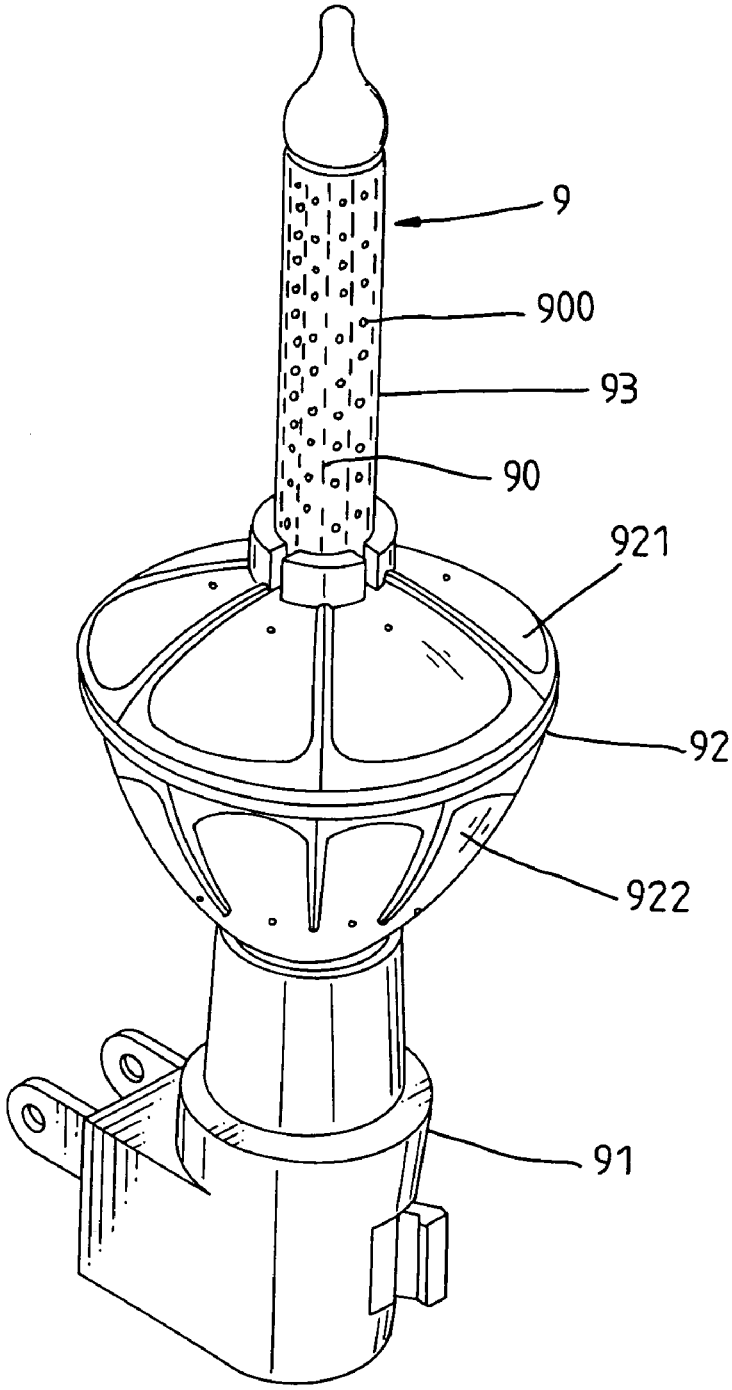
Fig.3 PRIOR ART
FIG. 3 is an elevational view of the decorative lamp assembly constructed according to the prior art.
Figure 4:
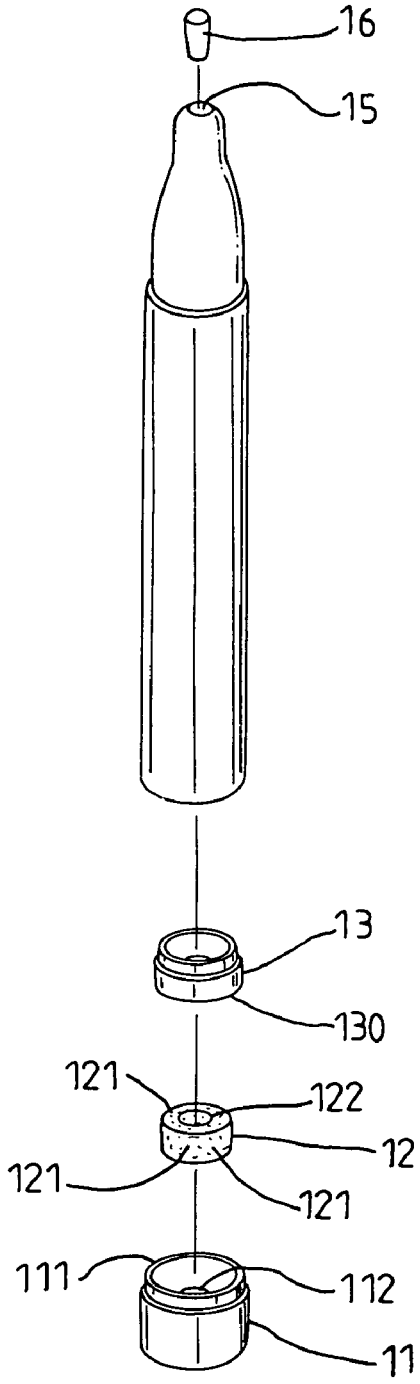
FIG. 4 is an exploded view of an ornamental tube for decorative lamp assembly according to the present invention.
Figure 5:
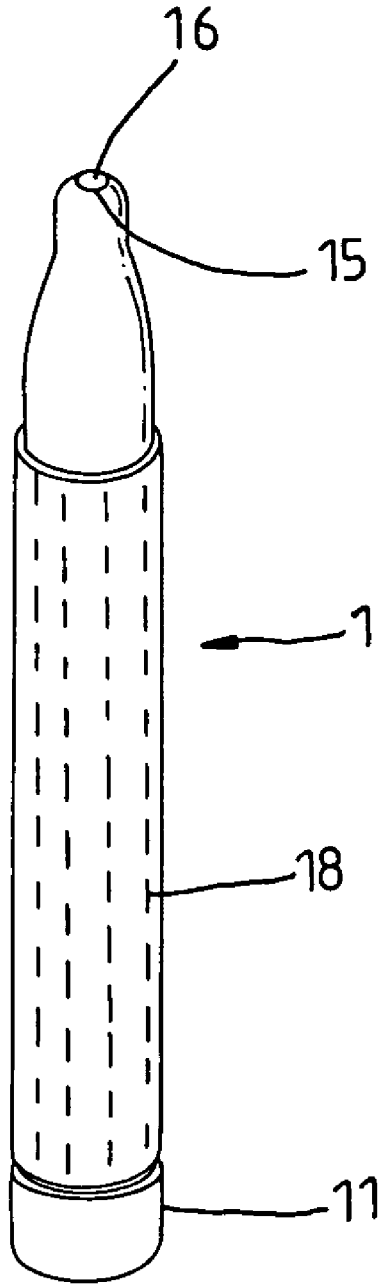
FIG. 5 is an assembly view of the ornamental tube shown in FIG. 4.

Referring to FIGS. 4–10, a decorative lamp assembly in accordance with the present invention is shown comprised of an ornamental tube 1 and a lamp 2. The ornamental tube 1 is stuffed with a stuffing material formed of organic solvent of low boiling point, for example, dichloromethane ($Ch_2Cl_2$) 18 and properly sealed, having a space 10 in the top side above the dichloromethane ($Ch_2Cl_2$) 18, and tiny pores 121 in the bottom side. The lamp 2 is comprised of an adapter 24, a bulb 21, a lampshade formed of an upper shell 22 and a bottom shell 23. The upper shell 22 has a top hole 221, which receives the bottom side of the ornamental tube 1. When turned on the bulb 21, heat energy is transmitted from the bulb 21 through the pores 121 in the bottom side of the ornamental tube 1 to dichloromethane 18 to boil dichloromethane 18, thereby causing a convection of bubbles 17 in the ornamental tube 1. At the same time, light rays pass from the bulb 21 through the bubbles 17, producing a lighting effect.

The main features of the present invention are outlined hereinafter. The ornamental tube 1 is molded from plastics and admits light, having the bottom side capped with a plastic bottom cap 11, and the top side provided with a filling hole 15, which is sealed with a plug 16 after filling of the dichloromethane 18 in the ornamental tube 1. The plastic bottom cap 11 admits light, and is internally mounted with a cushion 12 and a spacer member 13. The spacer member 13 is molded from plastics, having a plurality of through holes 131 and 132 through the top and bottom sides. The cushion 12 is a porous member made of a foamed material, for example, sponge, having pores 121 in it. Dichloromethane 18 passes through the through holes 131 and 132 of the spacer member 13 to the pores 121 in the cushion 12 where dichloromethane 18 is quickly boiled by heat from the bulb 21, thereby a convection of bubbles 17 to be produced in the ornamental tube 1. The through holes 131 and 132 stabilize the formation of the convection of bubbles 17.

Figure 6:
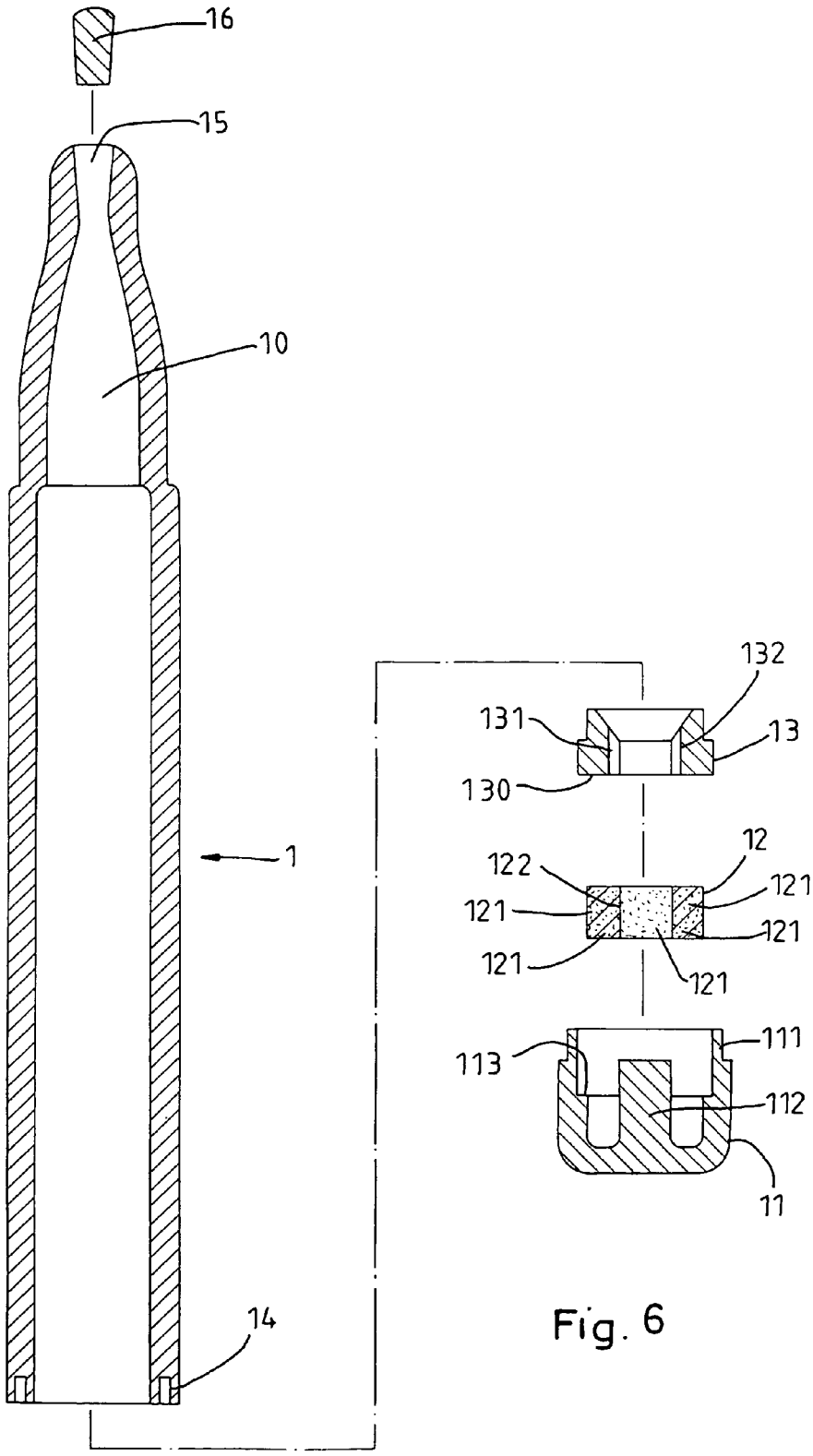
FIG. 6 is an exploded view in section in an enlarged scale of the ornamental tube shown in FIG. 4.
Figure 7:
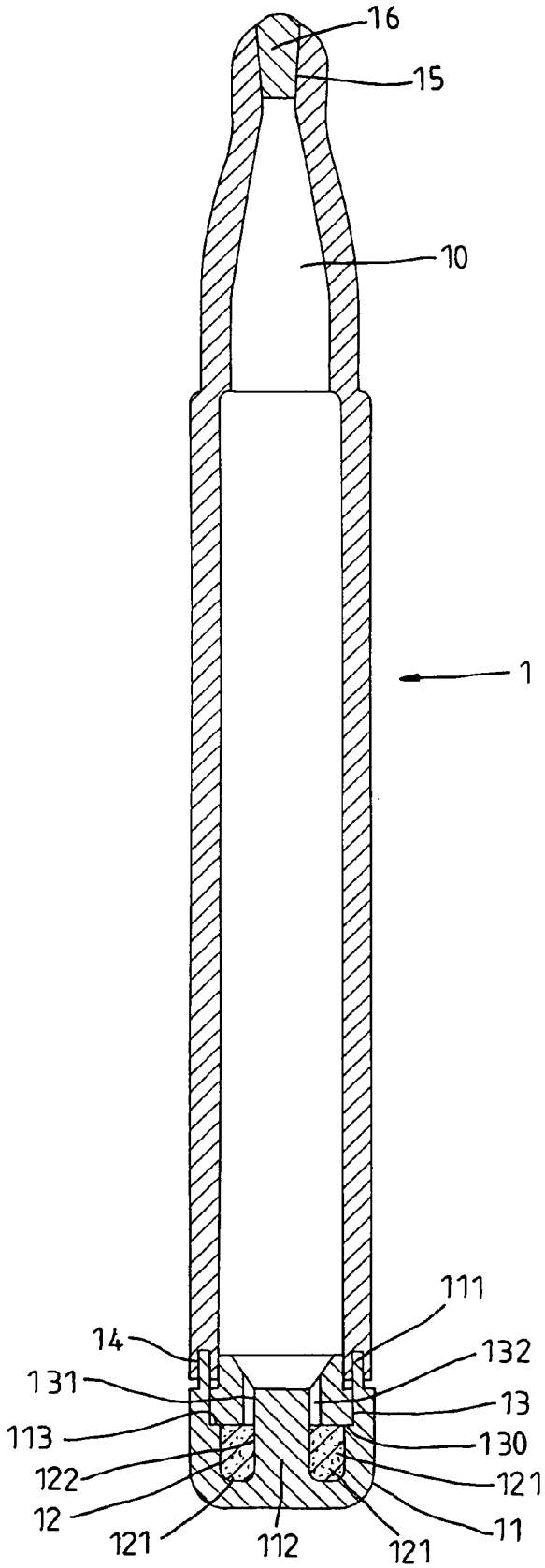
FIG. 7 is an assembly view of FIG. 6.
Figure 8:
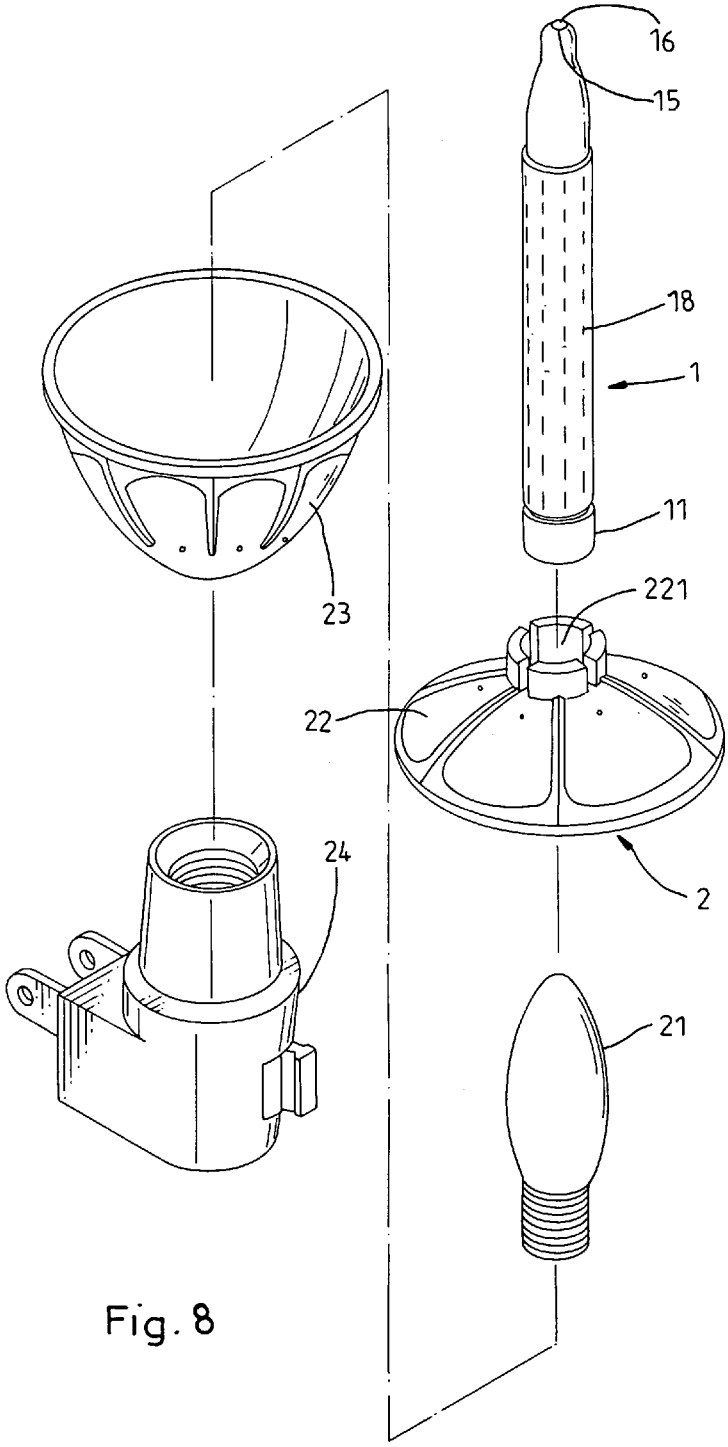
FIG. 8 is an exploded view of a decorative lamp assembly constructed according to the present invention.
Figure 9:
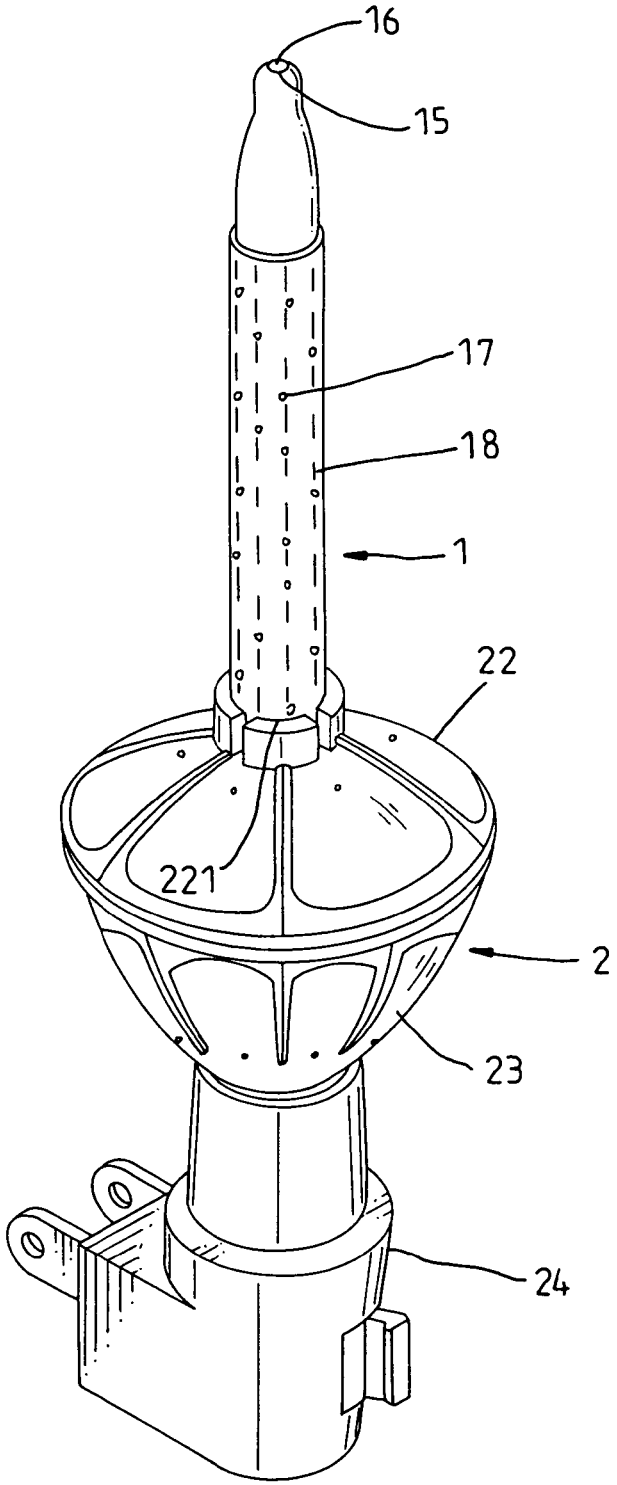
FIG. 9 is an elevational assembly view of the decorative lamp assembly shown in FIG. 8.
Figure 10:
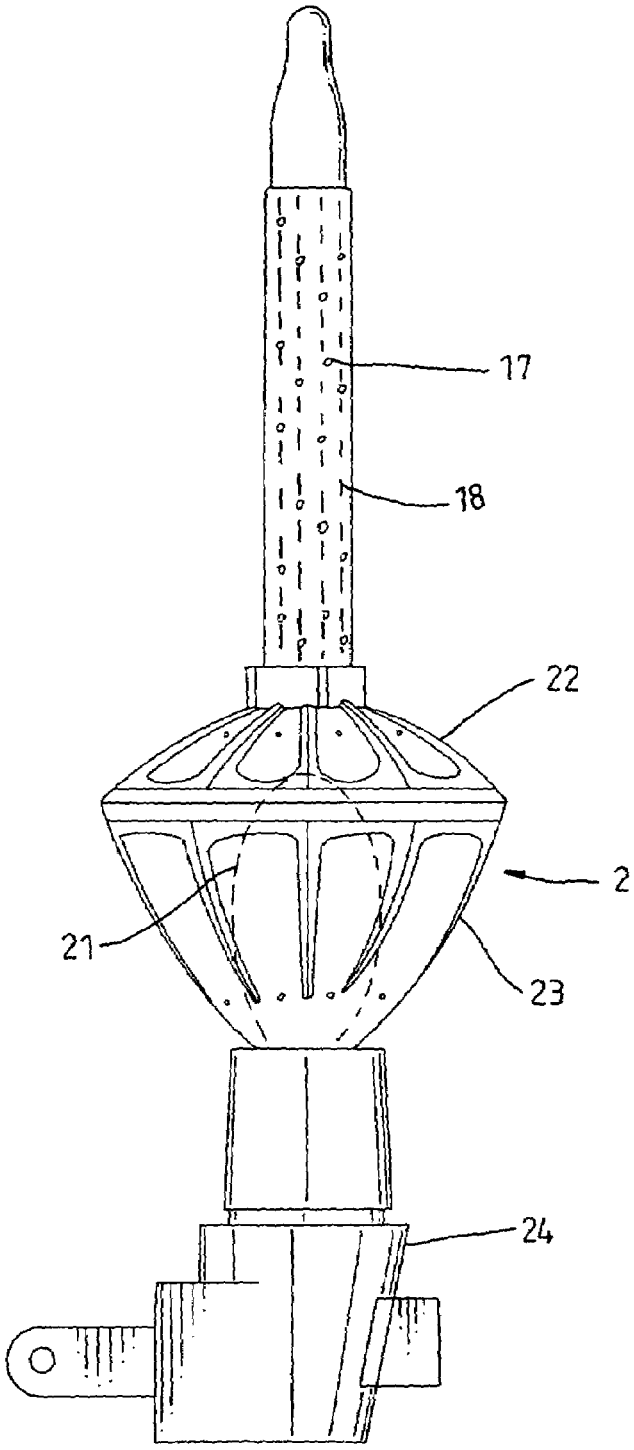
FIG. 10 is a plain view showing an operation status of the decorative lamp assembly of FIG. 9.

The ornamental tube 1 has an annular mounting groove 14 in the bottom side of the body thereof (see FIG. 6). The plastic bottom cap 11 has a mounting flange 111 press-fitted into the annular mounting groove 14 of the ornamental tube 1. After engagement of the mounting flange 111 into the annular mounting groove 14, the plastic bottom cap 11 is sealed to the ornamental tube 1 by an ultrasonic heat-sealing apparatus. The plastic bottom cap 11 further comprises a center mounting rod 112 axially forwardly suspended on the inside and inserted into the axial center hole 122 of the cushion 12 to hold the cushion 12 in place, and an inside annular groove 113, which accommodates the bottom side 130 of the spacer member 13.

Figure 11:
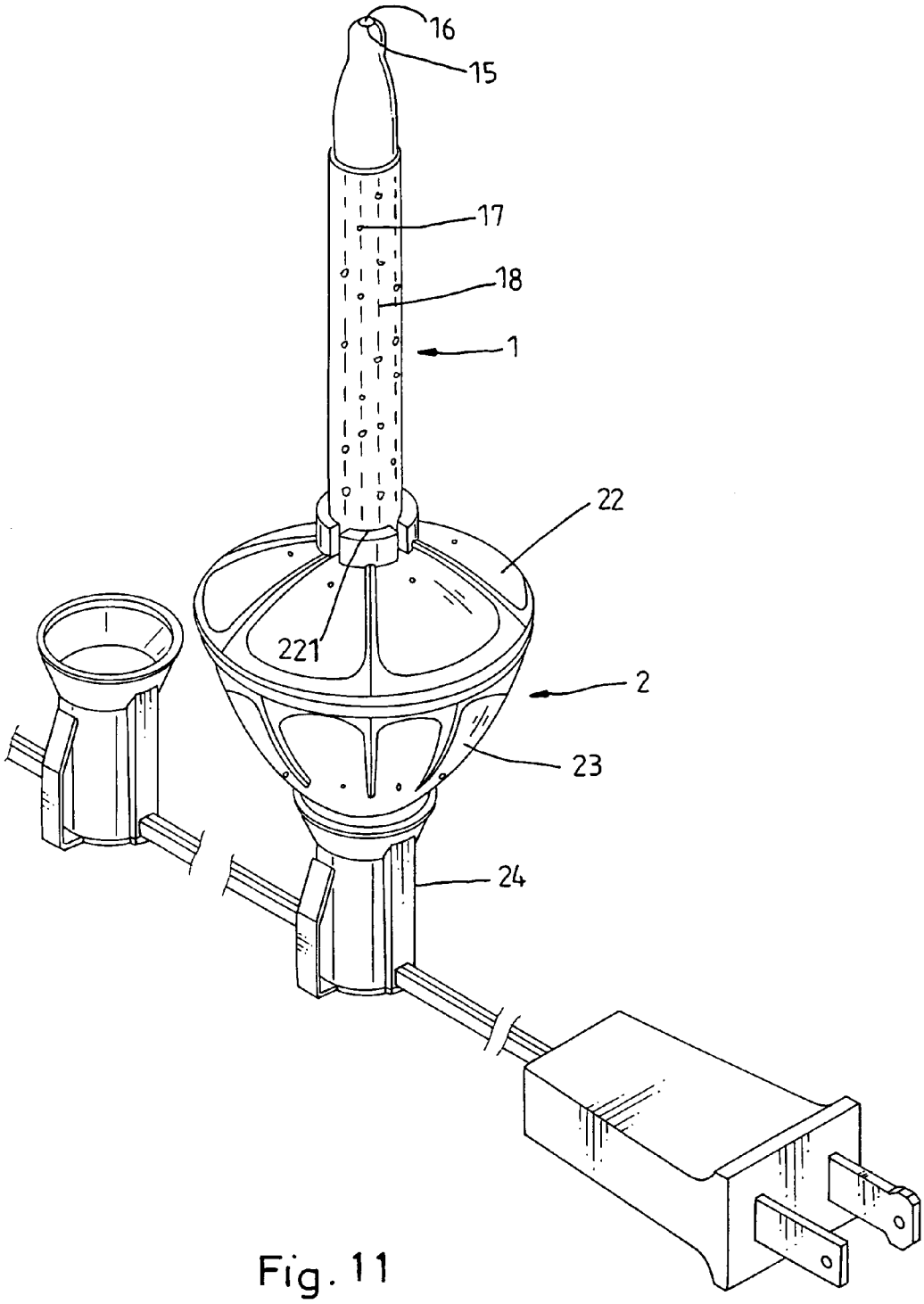
FIG. 11 is an elevational view of an alternate form of the decorative lamp assembly constructed according to the present invention.

FIG. 11 shows an alternate form of the decorative lamp assembly according to the present invention.

As indicated above, the invention has the following advantages:

1. Because the ornamental tube 1, the spacer member 13 and the bottom cap 11 are respectively molded from plastics, the decorative lamp assembly is safe in use.
2. The spacer member 13 enables dichloromethane to pass to the cushion 12 and then to be quickly boiled into bubbles quickly.
3. The through holes of the spacer member 13 guide dichloromethane to pass to the cushion 12 for boiling and produced bubbles to pass from the cushion 12 toward the space 10, therefore a stable convection of bubbles 17 is quickly produced when turned on the bulb 21.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. An ornamental tube fastened to the lampshade of a lamp and holding an organic solvent for heating into a boiling status by heat energy from a lamp bulb in said lampshade to produce a convection of bubbles below an inside space thereof, the ornamental tube comprising a plastic tube body holding said organic solvent and defining said space above said organic solvent, said plastic tube body admitting light and having an open bottom side, a plastic bottom cap capped on the open bottom side of said plastic tube body, said spacer member admitting light, a spacer member mounted inside said plastic bottom cap and sealed to the bottom open side of said tube body, said plastic bottom cap having a plurality of through holes through top and bottom sides thereof for guiding said organic solvent from said tube body to the inside of said plastic bottom cap for heating by heat from said lamp bulb, and a porous cushion mounted in between said plastic bottom cap and said spacer member and adapted to absorb said organic solvent for heating by heat energy from said lamp bulb, said porous cushion having a plurality of pores.

2. The ornamental tube as claimed in claim 1, wherein said tube body comprises an annular mounting groove in the bottom open side thereof; said plastic bottom cap comprises a mounting flange press-fitted into said annular mounting groove of said tube body.

3. The ornamental tube as claimed in claim 1, wherein said plastic bottom cap comprises an axially forwardly suspended inside mounting rod; said porous cushion comprises an axial center through hole, which receives the inside mounting rod of said plastic bottom cap.

4. The ornamental tube as claimed in claim 1, wherein said porous cushion is made of sponge.

5. The ornamental tube as claimed in claim 1, wherein said tube body comprises a filling hole through which said organic solvent is filled into said tube body, and a seal member sealing said filling hole after filling of said organic solvent in said tube body.

6. The ornamental tube as claimed in claim 1, wherein said plastic bottom cap comprises an inside annular groove adapted to accommodate said spacer member.

* * * * *